US008453367B2

(12) United States Patent
Overstreet et al.

(10) Patent No.: US 8,453,367 B2
(45) Date of Patent: Jun. 4, 2013

(54) MAINTENANCE KIT INCORPORATED INTO SUB CALIBER ACTION DEVICE

(75) Inventors: John L. Overstreet, Fayette, MO (US); Charles C. Kelly, Kirksville, MO (US); Jordan Bowles, Columbia, MO (US)

(73) Assignee: 22 Evolution LLC, Columbia, MO (US)

( * ) Notice: Subject to any disclaimer, the term of this patent is extended or adjusted under 35 U.S.C. 154(b) by 195 days.

(21) Appl. No.: 13/105,252

(22) Filed: May 11, 2011

(65) Prior Publication Data

US 2011/0277368 A1 Nov. 17, 2011

Related U.S. Application Data

(60) Provisional application No. 61/334,313, filed on May 13, 2010.

(51) Int. Cl.
*F41C 27/00* (2006.01)

(52) U.S. Cl.
USPC ..... 42/108; 42/16

(58) Field of Classification Search
USPC ..... 42/16, 108, 77; 89/29
See application file for complete search history.

(56) References Cited

U.S. PATENT DOCUMENTS

| | | | | |
|---|---|---|---|---|
| 3,776,095 | A * | 12/1973 | Atchisson | 89/128 |
| 4,169,329 | A * | 10/1979 | Atchisson | 42/16 |
| 4,297,800 | A * | 11/1981 | Atchisson | 42/49.02 |
| 4,709,496 | A | 12/1987 | Johnson | |
| 6,732,465 | B2 | 5/2004 | Strayer | |
| 7,219,461 | B1 | 5/2007 | Keeney et al. | |
| 7,380,362 | B2 | 6/2008 | Curry et al. | |
| 7,958,662 | B2 | 6/2011 | Mossberg et al. | |

* cited by examiner

*Primary Examiner* — Gabriel Klein
(74) *Attorney, Agent, or Firm* — Gifford, Krass, Sprinkle, Anderson & Citkowski, P.C.; Douglas J. McEvoy

(57) ABSTRACT

A maintenance kit incorporated into operable components of a sub caliber action device installable within an upper receiver of an AR-15 type firearm for facilitating disassembly, maintenance and reassembly of a bolt and forward chamber adaptor with a receiver plate. The kit includes at least one gauge dimension defined in a barrel of the forward chamber adaptor for establishing a correct spacing between lengthwise extending and interior notch defining arms associated with the receiver plate. A modified guide rod facilitates at least one of disassembly of the bolt firing pin/extractor and cleaning of the chamber adaptor interior prior to reassembly of the bolt and chamber adaptor.

9 Claims, 5 Drawing Sheets

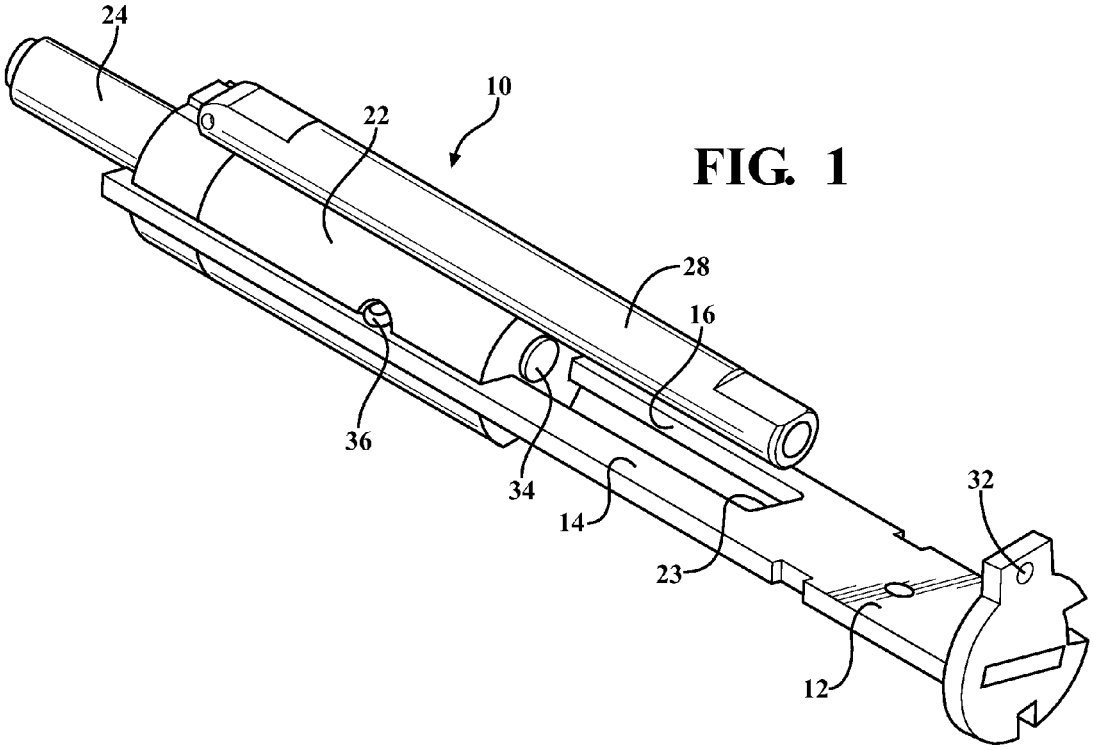
FIG. 1
FIG. 3
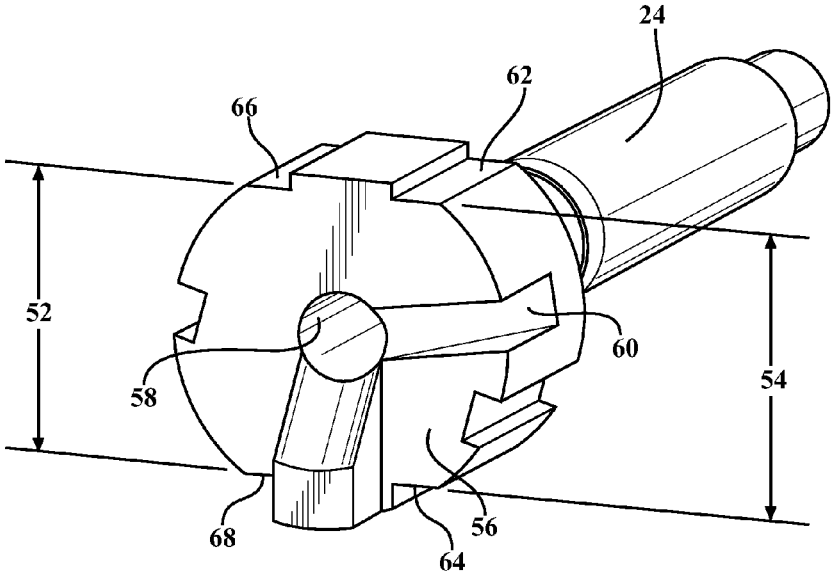

MAINTENANCE KIT INCORPORATED INTO SUB CALIBER ACTION DEVICE

CROSS-REFERENCE TO RELATED APPLICATIONS

This Application claims the benefit of U.S. Provisional Application 61/334,313 filed on May 13, 2010.

FIELD OF THE INVENTION

The present invention discloses a series of modifications incorporated into a sub caliber action device for assisting in deconstruction, maintenance, reassembly and reinstallation within the AR-15 upper receiver. Included is a modified guide rod which, upon disassembly along with the bolt from the receiver plate, facilitates disassembly of the cotter pin retaining the rear installed firing pin and the extractor support pin. The guide rod is also capable of being secured to an aperture in the receiver plate in a "T" mounting configuration and exhibits a lengthwise slot for receiving a wipe fabric for cleaning out the interior of the detached chamber adaptor. Finally, the chamber adaptor exhibits a pair of GO/NO GO inspection dimensions on its rear barrel for quickly establishing whether the receive plate arms have been deformed (separated) to an unacceptable degree and require modification prior to reassembly of the bolt and chamber adaptor.

BACKGROUND OF THE INVENTION

A known component associated with AR-15 and M16 style rifles is the action assembly, this most basically including a reciprocating bolt subassembly mounted upon a receiver plate and which is integrated into the upper receiver in communication with a magazine ammunition feed incorporated into an engaged lower receiver. Disassembly and modification of the action assembly is often desired, such as in instances where sub caliber conversion is desired (e.g. such as to modify the action assembly originally constructed for use with center fire cartridges so as to permit firing of lesser expensive rim fire cartridges.

The tension and dimensional tolerance of the receiver frame is also critical to the proper functioning of the firearm and the removal of the bolt and associated chamber adapter often results in undesirable changes being made to critical frame dimensions.

SUMMARY OF THE INVENTION

The present invention discloses a maintenance kit incorporated into operable components of a sub caliber action device installable within an upper receiver of an AR-15 type firearm for facilitating disassembly, maintenance and reassembly of a bolt and forward chamber adaptor with a receiver plate. The kit includes at least one gauge dimension defined in a barrel of the forward chamber adaptor for establishing a correct spacing between lengthwise extending and interior notch defining arms associated with the receiver plate. A modified guide rod facilitates at least one of disassembly of the bolt firing pin/extractor and cleaning of the chamber adaptor interior prior to reassembly of the bolt and chamber adaptor.

Additional features include the chamber adaptor further exhibiting a first NO GO gauge dimension and a second smaller GO dimension. The first and second dimensions further include opposite ledge surfaces established at locations upon the barrel.

The guide rod further comprising an annular enlarged end which, upon inserting the rod in a lengthwise fashion through a defined aperture in the base of the receiver plate, anchors the guide rod to the receiver plate. A slot defined in a distal proximate location of said guide rod for receiving a wipe fabric. The guide rod further exhibits a reduced end diameter distal end portion suitably dimensioned to facilitate disassembly of a firing pin as well as further facilitating forced dislodgement of the extractor support pin for subsequent removal of the extractor.

BRIEF DESCRIPTION OF THE DRAWINGS

Reference will now be made to the attached drawings, when read in combination with the following detailed description, wherein like reference numerals refer to like parts throughout the several views, and in which:

FIG. 1 is a substantially assembled perspective of a typical sub caliber action device (absent the guide rod and supported coil spring for biasing the bolt sleeve) according to the invention prior to removal of the forward chamber adaptor and bolt;

FIG. 3 is a rotated sectional perspective of the modified chamber adaptor and which exhibits a pair of GO/NO GO gauge dimensions formed in the barrel portion and which, when the adaptor is disassembled along with the bolt, quickly establishes whether the receiver plate arms have been unacceptably deformed during the disassembly process;

DETAILED DESCRIPTION OF THE PREFERRED EMBODIMENTS

Referring now to the following illustrations, the present invention again discloses a maintenance kit incorporated into the operating components of a sub caliber action device for use in both drop-in and dedicated variants of an AR-15 upper receiver. Among the objectives of the integrated kit is the prevention of unacceptable deformation of the receiver plate support arms during disassembly of the bolt and forward chamber adaptor (via the quick inspection GO/NO GO template markings placed upon the chamber adaptor barrel), combined with the modifications to the guide rod to facilitate subsequent removal of the firing pin and extractor from the dismounted bolt.

The integrated maintenance kit features associated with the depicted sub caliber action is intended to compensate for inherent deformation which is inflicted upon the guide plate arms during twisting separation and removal of the chamber adaptor and bolt for such as cleaning and in order to change out (replace) such s the firing pin and/or extractor. While it is not normally recommended to disassemble the action components in such a fashion, such is normally done for purposes of ease in accessing in particular the bolt components. It is further known that disassembly in such a fashion can change the critical dimension of the receiver plate arms resulting in decreased performance or jamming of the reciprocating bolt during subsequent reassembly.

Figure 2:
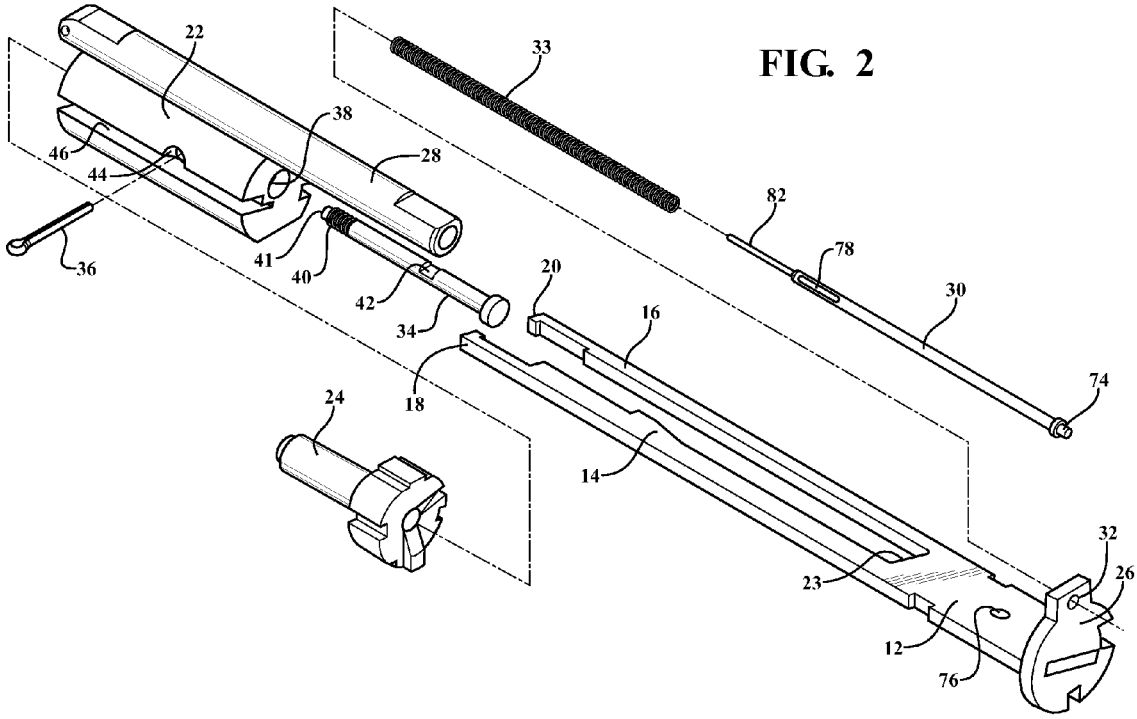
FIG. 2 is an exploded view of the sub caliber action device and better illustrating the modified guide rod for assisting in maintenance of the bolt and chamber adaptor.

Referring to each of FIGS. 1 and 2, both assembled and exploded perspectives are shown of a sub caliber action device (generally shown at 10 in FIG. 1) and which includes a generally elongated receiver plate 12 exhibiting a generally lengthwise extending and notched or keyed interior established between generally parallel extending sides 14 and 16, the sides terminating in a pair of inwardly facing and opposing end tabs 18 and 20. The sizing and dimensioning of the receiver plate interior seats and supports the bolt 22 in reciprocating fashion between a rear edge 23 of the of the internal slot and a forward chamber adapter 24 during normal installation and operation.

The configuration of the bolt assembly 22 is further such that a rearward projecting support sleeve 28 includes an open interior for receiving and seating an opposing guide rod 30 associated with a further mounting location 32 of the receiver plate 12 (this associated with a support plate 26 fixed to an end of the receiver plate 12) and in order to maintain in assembled fashion the adaptor bolt subassembly 10 (such as is known as a .22 caliber adaptor bolt). An elongated spring 33 seats over the guide rod 30 and, upon installation within the integrated support sleeve 28 provides the forward influencing bias to the bolt 22 when mounted upon the receiver 12.

Features associated with the bolt 22 further include a firing pin 34 which is held in place by a cotter pin 36. The firing pin 34 installs through a rear accessible aperture 38 in the bolt 22 and exhibits a smaller spring 40 mounted to a reduce diameter nose end 41 of the pin 34 to provide a limited degree of biasing motion within the bolt 22.

Figure 10:
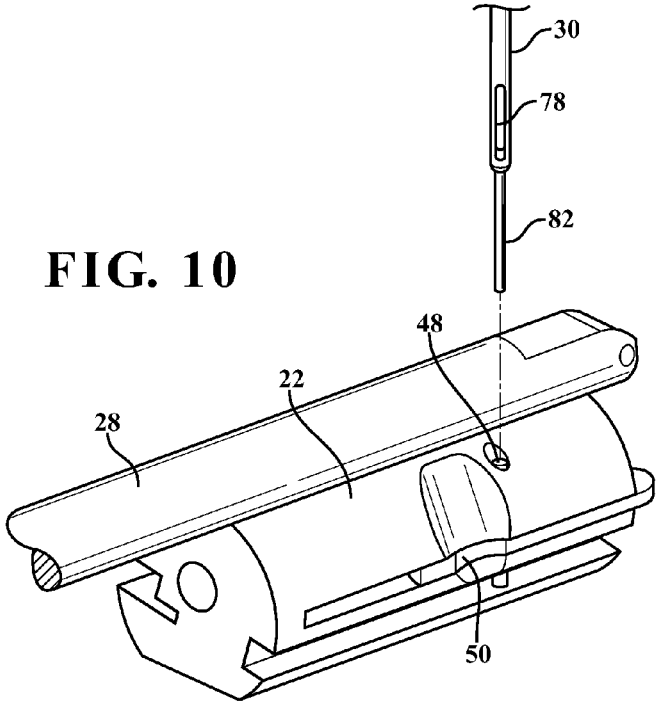
FIG. 10 is a further reverse side illustration of the bolt and depicting the modified guide rod in a further engaging position for forcible removing the extractor support pin.

A laterally communicating notch 42 is defined at an intermediate location of the pin 34 to secure the pin upon crosswise insertion of the cotter pin 36 through a widthwise communicating aperture 44 defined through a side of the bolt 22 and in intersecting communication with the lengthwise accessible aperture 38 for seating the firing pin 34. As also shown in FIG. 2, opposite side and length extending notches (see as shown at 46) are defined in the extending sides of the bolt 22 and which seat in traversing fashion between the sides 14 and 16 of the receiver plate 12. As will be described, the spatial dimensioning of the receiver plate sides 14 and 16 is critical for correcting support and operation of the bolt 22. A reverse side of the bolt (see FIG. 10) includes additional features such as an extractor pin 48 seating within a vertically extending aperture within the bolt for pivotally supporting an extractor 50 mounted to the bolt 22 in side accessible fashion.

As is known, the bolt assembly is a mechanical part of the firearm upper receiver and which is seated within a barrel at a location in which it blocks a rear of the associated chamber during burning of the propellant. In semi-automatic firearms, such as is the case AR-15 type firearms, the bolt is caused to cycle back and forth during each cartridge discharge cycle, propelled by recoil/expanding gas (backwards) or spring recoil (forwards) via a forward extending gas port and an upper and rear extending/rerouting of a gas tube for utilizing the gas blowback to successively eject and reload (re-chamber) a succeeding round.

Upon moving back, the bolt extractor 50 (see again FIG. 10) pulls a spent cartridge casing (not shown) from an attached magazine (not shown) and pushes it into a firearm chamber established between the upper and lower assembled receivers. Upon successive discharge, and once the spent shell casing case is clear of the chamber, an ejector component of the bolt ejects the casing from the receiver and out of the firearm (such as through a side window of the upper receiver which exposes the firing chamber.

Although not illustrated, the sub caliber action 10 is installed within an upper receiver rear end associated with an AR-15 firearm. Without further elaboration, additional existing and interfacing features associated with the upper receiver include an underside accessible aperture defined in a lengthwise configured barrel portion for receiving an associated lower receiver and communicating magazine (both also not shown), and within which is installed the action assembly 10.

Figure 7:
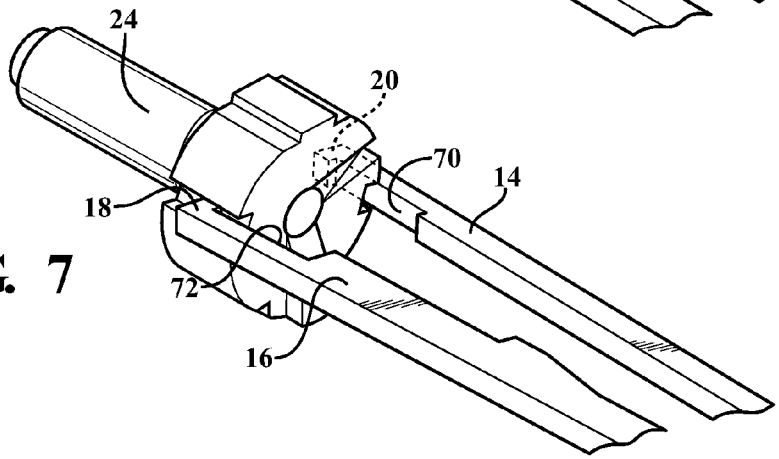
FIG. 7 is a succeeding view illustrating the chamber adaptor manipulated relative to the spaced apart and opposing ends of the receiver plate and in order to determine by quick inspection whether the receiver plate arms have been unacceptable deformed during disassembly of the bolt and chamber adaptor.
Figure 8:
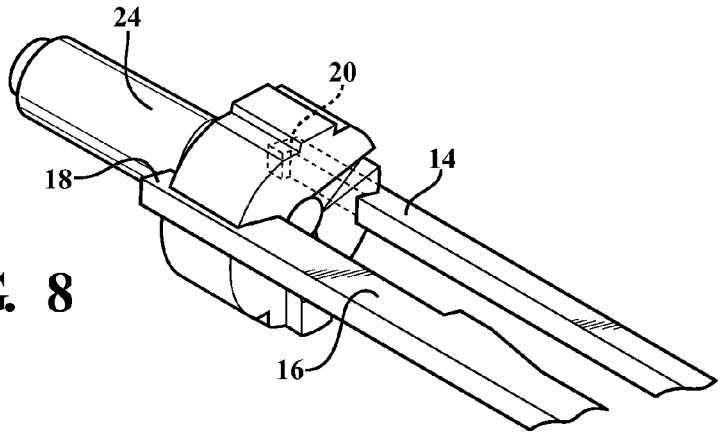
FIG. 8 is a reassembly illustration of the chamber adaptor secured between the extending ends of the receiver plate guide arms (and not showing the typically pre-assembled bolt)

FIG. 3 is a rotated sectional perspective of the modified chamber adaptor 24 and which exhibits a pair of GO (52) and NO GO (54) gauge dimensions formed in a barrel portion 56 through which is defined the projectile passageway 58 and gas assist passageway 60. In application, the dimensions 52 and 54 are defined by respective pairs of opposite ledge surfaces 62 & 64 and 66 & 68 which, when the adaptor 24 is disassembled along with the bolt 24, is manipulated in the manner best illustrated in FIG. 7 to measure the spacing established between opposing inner surfaces 70 and 72 of the receiver sides 14 and 16 proximate the end extending tabs 18 and 20.

In practice, the gauge dimensions 52 and 54 quickly establish whether the receiver plate arms have been unacceptably deformed such as during the disassembly process. By non-limiting example, this includes measuring the gap or spacing between the surfaces 70 and 72 by reference to the NO GO gauge dimension 54 (which in one non-limiting example lists a distance of 0.715" established between selected ledge surfaces 66 and 68 of the chamber adaptor barrel 56).

The ability to seat the (opposite) ledge surfaces 66 and 68 of the NO GO 54 dimension between the (opposing) receiver notch surfaces 70 and 72 signals that the receiver sides 14 and 16 have been unacceptably deformed (or widened) and that the sides need to be (such as manually) deformed to a degree that they contact the corresponding ledge surfaces 62 and 64 of the GO position 52 (dimensioned by non-limiting example to 0.705") and once the adaptor 24 has been manipulated to measure that distance between the receiver notch surfaces 70 and 72.

Figure 4:
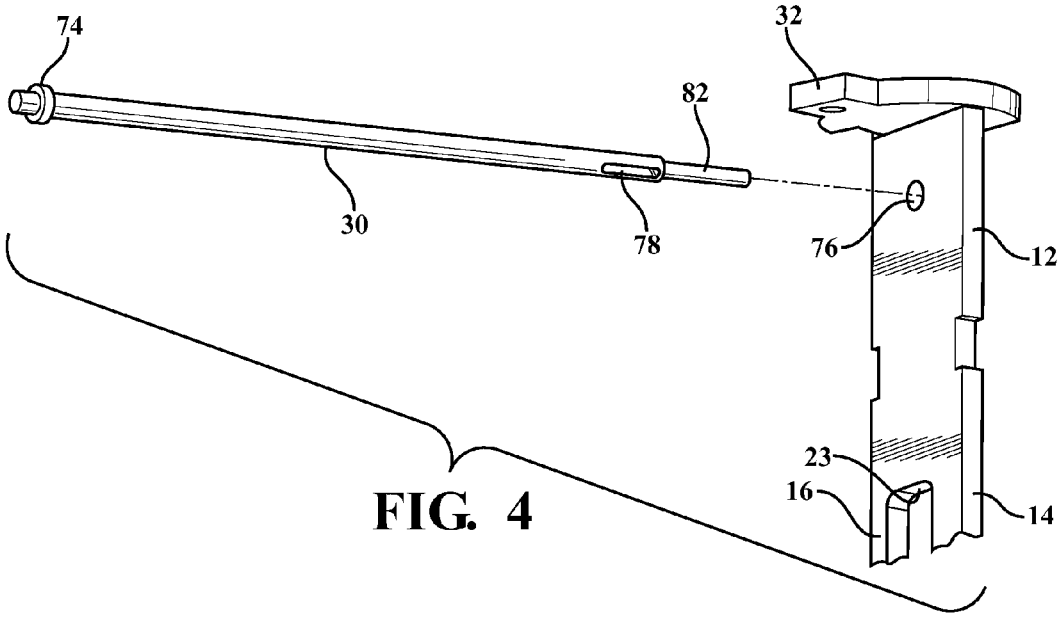
FIG. 4 is an exploded view of the modified guide rod arranged in a pre-assembled position relative to the receiver plate in a "T" handle configuration.

FIG. 4 is an exploded view of the modified guide rod 30 arranged in a pre-assembled position relative to the receiver plate 12 in a "T" handle configuration. The guide rod 30 includes an annular enlarged collar 74 proximate an associated end which, upon inserting the rod 30 in a lengthwise fashion through a defined aperture 76 at a base location of the receiver plate 12, anchors the guide rod 30 to the receiver plate 12.

Figure 5:
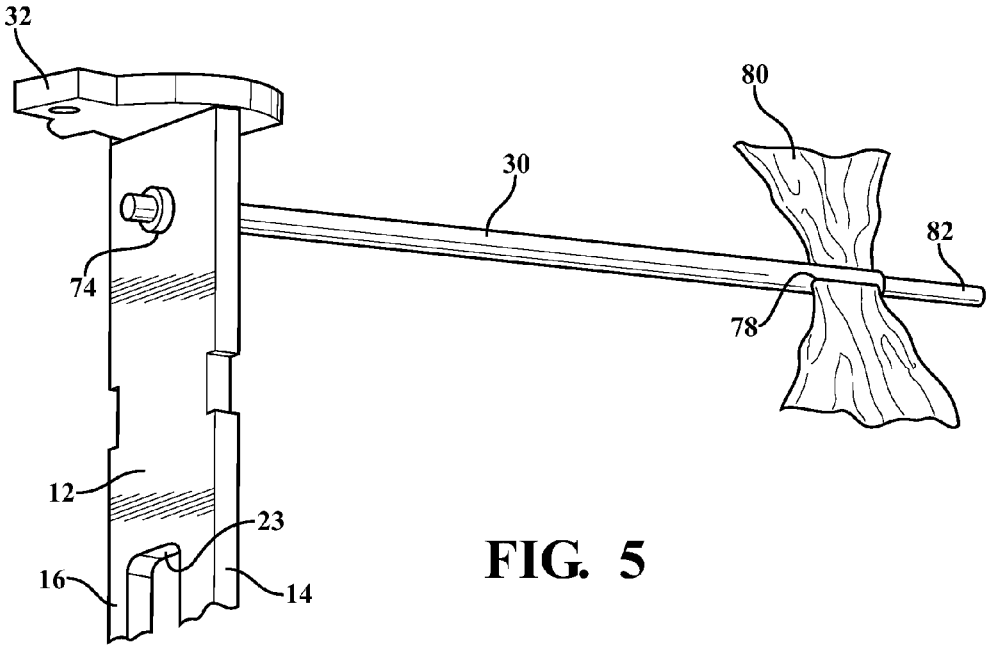
FIG. 5 is a successive assembled view of the guide rod and handle and further showing a wipe fabric attached through a distal end slot formed in the guide rod for swabbing an interior of the chamber adaptor.
Figure 6:
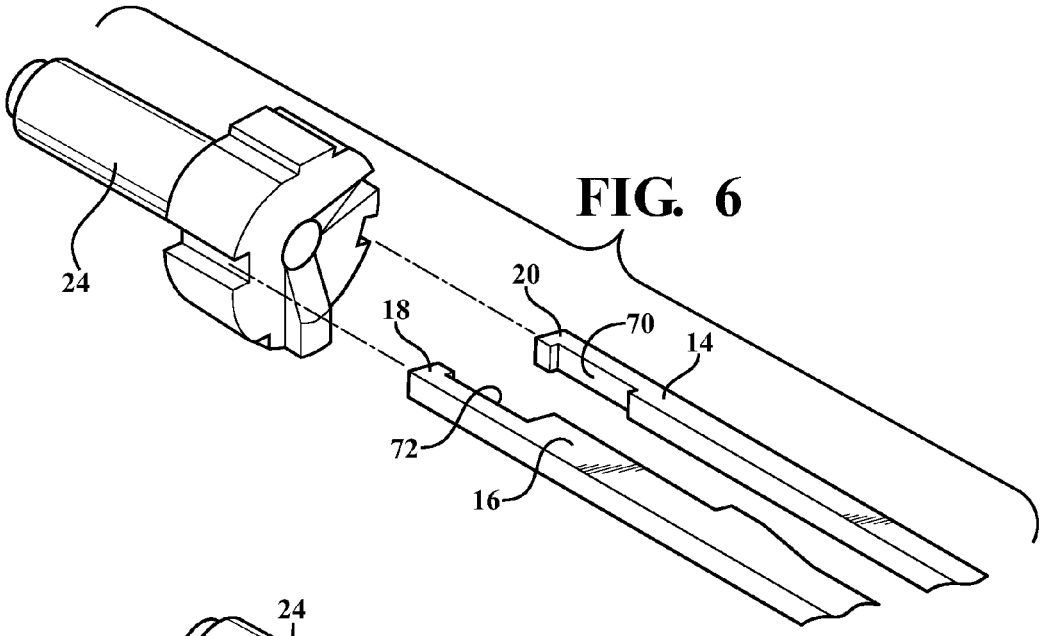
FIG. 6 is an environmental view of the chamber adaptor in FIG. 3 illustrated in disassembled fashion from the receiver plate.
Figure 9:
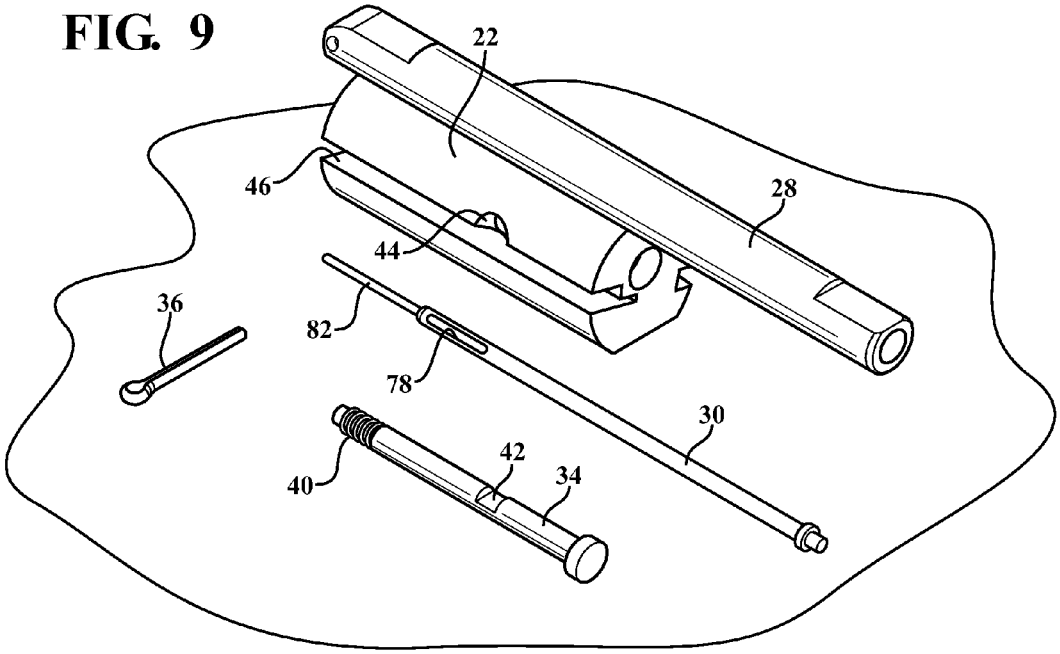
FIG. 9 is a generally side illustration of a bolt and, in cooperation with FIG. 2, illustrating the rear removal of the firing pin (via side inserted cotter pin) which is facilitated by the reduced diameter end portion of the modified guide rod.

Additional features include a slot 78 defined in a distal proximate location of the rod 30 and, as further illustrated in the successive assembled view of the guide rod and handle in FIG. 5, further shows a wipe fabric 80 attached through the distal end slot 78 formed in the guide rod for swabbing the interior 58 of the chamber adaptor 24. Also provided is a reduced end diameter distal end portion 82 which is suitably dimensioned to facilitate disassembly of the firing pin 34 (via removal of the side cotter pin 36) as depicted in FIG. 9, as well as further facilitating forced dislodgement of the extractor support pin 48 (see upper engaging position of FIG. 10) for subsequent removal of the extractor 50.

Having described my invention, other and additional preferred embodiments will become apparent to those skilled in the art to which it pertains, and without deviating from the scope of the appended claims.

We claim:

1. A maintenance kit incorporated into operable components of a sub caliber action device installable within an upper receiver of a semi-automatic rifle for facilitating disassembly, maintenance and reassembly of a bolt and a forward chamber adaptor with a receiver plate, comprising: at least one gauge dimension defined in a barrel of the forward chamber adaptor for establishing a correct spacing between lengthwise extending and interior notch defining arms associated with the receiver plate; a modified guide rod for facilitating disassembly of either of a firing pin associated with the bolt or an extractor pin associated with the bolt, said guide rod also for assisting in cleaning of the chamber adaptor interior prior to reassembly of the bolt and chamber adaptor; said guide rod comprising a distal cylindrical end portion defining a first end of the guide rod and having a first diameter to facilitate disassembly of the firing pin as well as facilitating forced dislodgement of the extractor pin for subsequent removal of an extractor mounted to the bolt, an intermediate cylindrical rod portion having a second diameter larger than the first diameter, and an annular enlarged collar extending radially outward from the cylindrical rod portion at a second end of the guide rod opposite the first end which, upon inserting the guide rod in a lengthwise fashion through a defined aperture in the base of the receiver plate, anchors the guide rod to the receiver plate; and a slot extending through the intermediate cylindrical rod portion for receiving a wipe fabric to facilitate cleaning of the chamber adaptor interior.

2. The invention as described in claim 1, the chamber adaptor further comprising a first NO GO gauge dimension and a second smaller GO dimension.

3. The invention as described in claim 2, said first and second dimensions further comprising opposite ledge surfaces established at locations upon said barrel.

4. A maintenance kit incorporated into operable components of a sub caliber action device installable within an upper receiver of a semi-automatic rifle for facilitating disassembly, maintenance and reassembly of a bolt and a forward chamber adaptor with a receiver plate, comprising: at least one gauge dimension defined in a barrel of the forward chamber adaptor for establishing a correct spacing between lengthwise extending and interior notch defining arms associated with the receiver plate; a modified guide rod for facilitating disassembly of either of a firing pin associated with the bolt or an extractor pin associated with the bolt, said guide rod also for assisting in cleaning of the chamber adaptor interior prior to reassembly of the bolt and chamber adaptor; said guide rod comprising a distal cylindrical end portion defining a first end of the guide rod and having a first diameter to facilitate disassembly of the firing pin as well as facilitating forced dislodgement of the extractor pin for subsequent removal of an extractor mounted to the bolt, and a cylindrical rod portion defining a second end of the guide rod and having a second diameter larger than the first diameter; and a slot extending through the cylindrical rod portion for receiving a wipe fabric to facilitate cleaning of the chamber adaptor interior.

5. The invention as described in claim 4, the chamber adaptor further comprising a first NO GO gauge dimension and a second smaller GO dimension.

6. The invention as described in claim 5, said first and second dimensions further comprising opposite ledge surfaces established at locations upon said barrel.

7. A maintenance kit incorporated into operable components of a sub caliber action device installable within an upper receiver of a semi-automatic rifle for facilitating disassembly, maintenance and reassembly of a bolt and a forward chamber adaptor with a receiver plate, comprising: at least one gauge dimension defined in a barrel of the forward chamber adaptor for establishing a correct spacing between lengthwise extending and interior notch defining arms associated with the receiver plate; a modified guide rod for facilitating disassembly of either of a firing pin associated with the bolt or an extractor pin associated with the bolt, said guide rod also for assisting in cleaning of the chamber adaptor interior prior to reassembly of the bolt and chamber adaptor; said guide rod comprising a distal cylindrical end portion defining a first end of the guide rod and having a first diameter to facilitate disassembly of the firing pin as well as facilitating forced dislodgement of the extractor pin for subsequent removal of an extractor mounted to the bolt, an intermediate cylindrical rod portion having a second diameter larger than the first diameter, and an annular enlarged collar extending radially outward from the cylindrical rod portion at a second end of the guide rod opposite the first end which, upon inserting the guide rod in a lengthwise fashion through a defined aperture in the base of the receiver plate, anchors the guide rod to the receiver plate; and a slot defined in the intermediate cylindrical rod portion for receiving a wipe fabric to facilitate cleaning of the chamber adaptor interior.

8. The invention as described in claim 7, the chamber adaptor further comprising a first NO GO gauge dimension and a second smaller GO dimension.

9. The invention as described in claim 8, said first and second dimensions further comprising opposite ledge surfaces established at locations upon said barrel.

* * * * *